US006020032A

United States Patent [19]

Romano, Jr. et al.

[11] Patent Number: 6,020,032

[45] Date of Patent: Feb. 1, 2000

[54] METHOD FOR PREPARING AN INK JET RECORDING ELEMENT

[75] Inventors: Charles E. Romano, Jr., Rochester; Eric L. Boyle, Penfield; Robert A. Guistina, Rochester, all of N.Y.

[73] Assignee: Eastman Kodak Company, Rochester, N.Y.

[21] Appl. No.: 09/193,641

[22] Filed: Nov. 18, 1998

[51] Int. Cl.[7] ..... B05D 1/36

[52] U.S. Cl. ..... 427/411; 427/412; 427/412.1

[58] Field of Search ..... 427/407.1, 411, 427/412.1, 412

[56] References Cited

U.S. PATENT DOCUMENTS 5,789,070 8/1998 Shaw-Klein et al. ..... 428/216

FOREIGN PATENT DOCUMENTS 0 747 230 A2 12/1996 European Pat. Off. .

09-150572 6/1997 Japan .

*Primary Examiner*—Erma Cameron

*Attorney, Agent, or Firm*—Harold E. Cole

[57] ABSTRACT

A method for making an ink jet recording element comprising simultaneously coating on a support the following layers in order:

a) a nonionic, water-dispersible, condensation polymer gloss-enhancing layer; and b) an ink receptive layer for an ink jet image.

10 Claims, No Drawings

METHOD FOR PREPARING AN INK JET RECORDING ELEMENT

FIELD OF THE INVENTION

The present invention relates to a method for preparing an ink jet mage-recording element which yields printed images with high optical densities, excellent image quality, higher gloss, and fast drying.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-recording layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have severely limited their commercial usefulness. The requirements for an image recording medium or element for ink jet recording are very demanding.

It is well known that in order to achieve and maintain photographic-quality images on such an image-recording element, an ink jet recording element must:

- Be readily wetted so there is no puddling, i.e., coalescence of adjacent ink dots, which leads to nonuniform density
- Exhibit no image bleeding
- Provide maximum printed optical densities
- Exhibit the ability to absorb high concentrations of ink and dry quickly to avoid elements blocking together when stacked against subsequent prints or other surfaces
- Provide a high level of gloss and avoid differential gloss
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light A desirable attribute for such an image-recording element is high gloss. High gloss is generally accomplished by either 1) melt extruding a resin, typically polyethylene, onto a fiber paper support or 2) by cast coating, a coating technique whereby the coating is pressed against a heated drum having a mirror-finished surface. While resin coating produces image-recording elements that have high gloss, this process requires specialized extrusion equipment, and a separate coating operation, and is therefore costly. Cast-coated papers are comparable in cost or slightly less expensive than resin-coated papers but require a special coating technique whereby the coating is treated with pressure and heat. Therefore, there is a need for a low cost, glossy image recording element that is easily manufactured without specialized coating equipment.

DESCRIPTION OF RELATED ART

EP 747,230A discloses an ink jet receiver wherein an adhesion-promoting interlayer, such as a polyester, is employed between the support and the ink-receptive layer. There is a problem with this polyester, however, in that this interlayer is anionic, which may require this material to be coated at a different time from the other layers which are cationic in order to prevent coagulation.

SUMMARY OF THE INVENTION

In accordance with the present invention, there is provided a method for making an ink jet recording element comprising simultaneously coating on a support the following layers in order:

a) a nonionic, water-dispersible, condensation polymer gloss-enhancing layer; and b) an ink receptive layer for an ink jet image.

The method of the invention provides the capability of providing images that have high gloss, excellent image quality, high optical densities, and a good color gamut.

The method of the invention is also low cost since the gloss-enhancing layer can be aqueous coated in-line simultaneously with the ink receiving layers and does not require the type of specialized coating equipment required for polyethylene extrusion or cast coating.

DETAILED DESCRIPTION OF THE INVENTION

The gloss-enhancing layer of the invention comprises a condensation polymer which is non-ionic, water-dispersible, and self-coalescing at coating temperatures.

Condensation polymers are well known in the art, a definition of which is found, for example, in C. E. Carraher Jr., Polymer Chemistry, $4^{th}$ Ed. Marcel Dekker, New York, pp 211–261. Condensation polymers useful in the invention include polyesters, polyurethanes, block copolymers of polyesters and polyurethanes, polyethers, block copolymers of polyesters and polyethers, block copolymers of polyurethanes and polyethers.

In a preferred embodiment of the invention, the condensation polymer is a polyester. Such a polyester would consist of one or more dicarboxylic acids copolymerized with one or more dihydroxy functional compounds and a non-ionic hydrophilic component which may or may not be copolymerized with the diacid and dihydroxy monomers. The non-ionic hydrophilic component is polymeric or oligomeric and lends water dispersibility to the polyester component.

In another preferred embodiment of the invention, the condensation polymer is a block copolymer of a polyester and a polyether, such as poly[terephthalic acid-co-isophthalic acid-co-ethylene glycol-block-poly(ethylene glycol)], the molar ratio of terephthalic acid to isophthalic acid being approximately 2:1. This material is available commercially as EvCote® P18NS manufactured by EvCo Research.

Examples of aromatic dicarboxylic acids useful in the polyester employed in the invention include, but are not limited to, terephthalic, isophthalic, phthalic, and 2,6-naphthoic. The aromatic dicarboxylic acid component of the acid fraction should be 50–100 mole % of the total diacid fraction.

Aliphatic diacid monomers may also be used in the diacid fraction of the polyester. Useful aliphatic diacids include, but are not limited to, succinic, glutaric, adipic, 1,4-cyclohexane dicarboxylic, maleic, fumaric and azelaic. The content of aliphatic diacid should be 0–50 mole % of the total dicarboxylic acid fraction of the polyester.

The glycol component of the non-ionic polyester can be virtually any dihydroxy functional compound. Aliphatic and alicyclic glycols would be the most useful. Useful glycols include, but are not limited to, ethylene glycol, 1,3-propylene glycol, 1,2-propylene glycol, dipropylene glycol, tripropylene glycol, 1,4-butanediol, 1,5-pentanediol, 1,6-hexanediol, cyclohexanedimethanol, diethylene glycol and triethylene glycol. An oligomeric dihydroxy-terminated poly(ethylene glycol) may also be employed such as those having the formula:

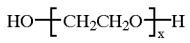

wherein x is an integer from about 4 to about 25.

Incorporation of such an oligomer into the polyester structure would cause the formation of hydrophilic blocks which will lend water dispersibility to the formulation.

Oligomeric dihydroxy-terminated poly(propylene glycol) may also be used in forming a non-ionic, hydrophilic component in the polyester, such as those having the general formula:

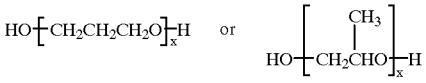

wherein x is an integer from about 4 to about 20.

The oligomeric dihydroxy compound may be copolymerized into the polyester structure leading to a block copolyester or they may be physically blended with a preformed non-ionic polyester. In either case, the oligomeric hydrophilic polymer leads to water dispersibility for the system.

Polyurethane copolymers are also useful in this invention as the gloss-enhancing layer. Polyurethanes are condensation copolymers consisting of one or more diisocyanate monomers co-reacted with one or more dihydroxy functional monomers. The polyurethane must be water dispersible, non-ionic and self-coalescing at coating temperatures. Examples of diisocyanate monomers useful in the invention include, but are not limited to, hexamethylene diisocyanate, 1,4-cyclohexane diisocyanate, 1,4-toluene diisocyanate, methylenecyclohexyl diisocyanate, isophorone diisocyanate, and methylenediphenyl diisocyanate.

The glycol component can be virtually any dihydroxy functional compound as listed above.

The nonionic water dispersible polymer employed in the invention is generally self coalescing at coating temperatures. This means that the polymer coalesces into a smooth, uniform, glossy layer spontaneously as the aqueous coating solvent is evaporated. Surface irregularities such as voids or areas of differing refractive indices due to phase separation must be avoided or else reduced gloss will result.

The molecular weight of the polymer used in the invention should be low enough such that extensive chain entanglement in the solid state is avoided. If molecular weight is too high, the polymer chains become extensively entangled and this often leads to rough surface morphology.

In general, polymers are used which have polystyrene equivalent weight average molecular weights of from 1500 to 30,000, preferably 2000 to 10,000. The EvCote® P18NS has a polystyrene equivalent weight average molecular weight of 3550.

The gloss-enhancing polymers employed in the invention generally have a glass transition temperature of from −100° C. to 40° C., preferably from −60° C. to 10° C. The EvCote® P18NS has a Tg of −46° C.

The ink receptive layer is primarily intended as a sponge layer for the adsorption of ink solvent. For water based inks, it is primarily composed of hydrophilic materials. This layer may comprise materials such as naturally-occurring hydrophilic colloids and gums such as gelatin, albumin, guar, xantham, acacia, chitosan, starches and their derivatives, and the like; derivatives of natural polymers such as functionalized proteins, functionalized gums and starches, and cellulose ethers and their derivatives; and synthetic polymers such as polyvinyloxazoline, polyvinylmethyloxazoline, polyoxides, polyethers, poly(ethylene imine), poly(acrylic acid), poly(methacrylic acid), n-vinyl amides including polyacrylamide and polyvinylpyrrolidone, and poly(vinyl alcohol), its derivatives and copolymers; and combinations of these materials. This layer may also comprise inorganic or organic particles such as silicas, modified silicas, clays, aluminas, polystyrene beads and the like in a binder. In general, this layer may be present in a dry thickness of about 5 to about 60 μm, preferably about 8 to about 45 μm.

The overcoat layer employed in the invention provides abrasion resistance, smudge and finger print resistance, friction control, image quality, etc. The overcoat layer employed in the invention may comprise any of the materials listed above for the ink receptive layer. In a preferred embodiment, the overcoat layer comprises a cationically-modified cellulose ether. In still another preferred embodiment, the cationically-modified cellulose ether is poly[β-D-1,4-anhydro-glucose-g-oxyethylene-g-(2'-hydroxypropyl)-N,N-dimethyl-N-dodecylammonium chloride]. In general, this overcoat layer may be present at a dry thickness of about 0.1 to about 5 μm, preferably about 0.25 to about 3 μm.

It is desirable to add a cationic polymer to the ink receptive and/or overcoat layers or to use ink receptive and or overcoat layers that are cationic polymers to mordant an anionic dye that is typically used in ink jet inks. These cationic materials react with the anionic dye and usually result in improved waterfastness, bleed, and RH sensitivity. Typical cationic polymers that can be used include poly (vinylbenzyl trimethylammonium chloride), poly(diallyldimethylammonium chloride), quaternary copolymers, quaternary acrylic latex copolymers, amidoepichlorohydrin copolymers, dimethylaminoethylmethacrylate copolymers, polyallylamine, and polyethyleneimine.

The nonionic, water-dispersible polyester gloss-enhancing layer improves the gloss of the recording element. The gloss-enhancing layer is aqueous coatable and capable of being coated in-line simultaneously with the ink receiving layers. The condensation polymer dispersion used to form the gloss-enhancing layer may contain additional addenda such as organic acids to stabilize the dispersion, viscosifiers, surfactants, and waxes, and the like.

In accordance with the invention, the non-ionic condensation polymer can be easily coated simultaneously with the ink receptive and/or overcoat layers containing cationic addenda using a multi-slot slide hopper.

If desired in order to improve the adhesion of the gloss-enhancing layer to the support, the surface of the support may be corona discharge treated prior to applying the gloss-enhancing layer to the support or, alternatively, an under-coating, such as a layer formed from a halogenated phenol or a partially hydrolyzed vinyl chloride-vinyl acetate copolymer can be applied on the surface of the support. In addition, such operations may also be performed on the gloss-enhancing layer to improve the adhesion between the gloss-enhancing layer and the solvent absorbing layer.

The solvent absorbing and overcoat layers may be pH adjusted and may contain addenda for enhancing its physical and optical properties such as matte, anti-oxidants, surfactants, light stabilizers, anti-static agents, surfactants, chemical cross-linking agents, cationic mordants and the like.

Any support or substrate may be used in the recording element of the invention. There may be used, for example calendered or uncalendered pulp-based paper, cast coated or clay coated papers, and woven fabrics such as cotton, nylon, polyester, rayon, and the like. In a preferred embodiment of the invention, the support is paper. The support usually has a thickness of from about 12 to about 500 $\mu$m, preferably from about 75 to 300 $\mu$m. Antioxidants, antistatic agents, plasticizers and other known additives may be incorporated into the support, if desired.

Optionally, an additional backing layer or coating may be applied to the backside of a support (i.e., the side of the support opposite the side on which the image-recording layer is coated) for the purposes of improving the machine-handling properties of the recording element, controlling the friction and resistivity thereof, and the like. Typically, the backing layer may comprise a binder and a filler. Typical fillers include amorphous and crystalline silicas, poly (methyl methacrylate), hollow sphere polystyrene beads, micro-crystalline cellulose, zinc oxide, talc, and the like. The filler loaded in the backing layer is generally less than 2 percent by weight of the binder component and the average particle size of the filler material is in the range of 5 to 15 $\mu$m, preferably 5 to 10 $\mu$m. Typical binders used in the backing layer are polymers such as acrylates, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzene-sulfonate sodium salt, octylsulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder.

In the present invention, when the ink is ejected from the nozzle of the ink jet printer in the form of individual droplets, the droplets pass through the image-recording layer where most of the dyes in the ink are retained or mordanted while the remaining dyes and the solvent or carrier portion of the ink pass freely through the image-recording layer to the solvent-absorbing layer where they are rapidly absorbed by the porous or microporous material. In this manner, large volumes of ink are quickly absorbed by the recording elements of the present invention giving rise to high quality recorded images having excellent optical density and good color gamut.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The image-recording layer used in the recording elements of the present invention can also contain various known additives, including matting agents such as titanium dioxide, zinc oxide, silica and polymeric beads such as crosslinked poly(methyl methacrylate) or polystyrene beads for the purposes of contributing to the non-blocking characteristics of the recording elements used in the present invention and to control the smudge resistance thereof; surfactants such as non-ionic, hydrocarbon or fluorocarbon surfactants or cationic surfactants, such as quaternary ammonium salts for the purpose of improving the aging behavior of the ink-absorbent resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; viscosity modifiers; dye-fixing agents; waterproofing agents; dispersing agents; UV-absorbing agents; mildew-proofing agents; mordants; antistatic agents, anti-oxidants, optical brighteners, and the like. Such additives can be selected from known compounds or materials in accordance with the objects to be achieved.

The following examples are provided to illustrate the invention.

EXAMPLES

All coatings were made on a photographic paper support. The support was produced by refining a pulp furnish of 12.5% bleached hardwood kraft (Pontiac PF81), 87.5% bleached softwood sulfite (Puget Plus®) through a double disc refiner, then a Jordan conical refiner to a Canadian Standard Freeness of 200 cc. To the resulting pulp furnish was added 0.4% alkyl ketene dimer, 1.0% cationic starch, 0.5% polyamide-epichlorohydrin, 0.2% anionic polyacrylamide resin, and 4.0% TiO2 on a dry weight basis. A 127 g/m$^2$ bone dry weight base paper was made on a Fourdrinier paper machine, wet pressed and then dried to a moisture of approximately 10% using steam-heated dryers. The paper base was then surface sized using a vertical size press with a 10% hydroxyethylated cornstarch solution to achieve a loading of 3.3 wt. % starch. The surface sized support was calendered to 0.127 mm.

Examples 1–9

On the above support were simultaneously coated the following layers in order:

a) a gloss-enhancing layer of a 20 wt % aqueous polyester dispersion of EvCote® P18NS (EvCo Research) to give a dried thickness ranging from 3.0 $\mu$m to 4.0 $\mu$m;

b) an ink-receptive layer of 13.6 wt % aqueous solution of lime-processed gelatin (Eastman Gelatin) at a dry coverage of 8 $\mu$m; and c) an overcoat layer at a dry coverage of 0.5 μm of either:

1) 2.08 wt % aqueous solution of poly[β-D-1,4-anhydroglucose-g-oxyethylene-g-(2'-hydroxypropyl)-N,N-dimethyl-N-dodecylammonium chloride], LM200, (Amerchol Co.) and 1.0 vol % of Olin 10G surfactant;

2) 3.23 wt % aqueous solution containing a 50/50 mixture of poly[β-D-1,4-anhydroglucose-g-oxyethylene-g-(2'-hydroxypropyl)-N,N-dimethyl-N-dodecylammonium chloride], LM200, and carboxymethyl cellulose (Celfix-5, Riverside Chemical Company) and about 1.0 vol % of Olin 10G surfactant; or 3) 1.62 wt % aqueous solution containing a 50/50 mixture of poly[β-D-1,4-anhydroglucose-g-oxyethylene-g-(2'-hydroxypropyl)-N,N-dimethyl-N-dodecylammonium chloride], LM200, and methyl cellulose (A4M, Dow Chemical) and about 1.0 vol % of Olin 10G surfactant.

The above layers were coated using a small scale pilot coating machine utilizing a multi-layer slide coating hopper. All layers were coated simultaneously and then air dried.

A control element was prepared similar to Examples 1–9 except that it did not have any gloss-enhancing layer.

The gloss of the coatings were then measured using a BYK-Gardener Gloss Meter. The following results were obtained:

TABLE 1

| Example | Thickness (μm) of Gloss-Enhancing Layer | Overcoat Layer | 60° Gloss |
|---|---|---|---|
| Control | None | 1 | 39.2 |
| Example 1 | 3.0 | 1 | 53.1 |
| Example 2 | 3.5 | 1 | 57.6 |
| Example 3 | 4.0 | 1 | 58.9 |
| Example 4 | 3.0 | 2 | 49.0 |
| Example 5 | 3.5 | 2 | 49.7 |
| Example 6 | 4.0 | 2 | 49.4 |
| Example 7 | 3.0 | 3 | 46.1 |
| Example 8 | 3.5 | 3 | 47.7 |
| Example 9 | 4.0 | 3 | 47.8 |

The above results show that the use of the process of the invention produces an ink jet recording element which has higher gloss as compared to a control element which did not contain any gloss-enhancing layer.

Although the invention has been described in detail with reference to certain preferred embodiments for the purpose of illustration, it is to be understood that variations and modifications can be made by those skilled in the art without departing from the spirit and scope of the invention.

What is claimed is:

1. A method for making an ink jet recording element comprising simultaneously coating on a support the following layers in order:

a) a nonionic, water-dispersible, condensation polymer gloss-enhancing layer; and b) an ink receptive layer for an ink jet image.

2. The process of claim 1 wherein said support is paper.

3. The process of claim 1 wherein said ink receptive layer comprises gelatin.

4. The process of claim 1 wherein said ink receptive layer is present in an amount of from about 5 to about 60 μm.

5. The process of claim 1 wherein said gloss-enhancing layer is present at a thickness of from about 2 to about 5 μm.

6. The process of claim 1 wherein said condensation polymer is a block copolymer of a polyester and a polyether.

7. The process of claim 6 wherein said block copolymer is poly[terephthalic acid-co-isophthalic acid-co-ethylene glycol-block-poly(ethylene glycol)].

8. The process of claim 1 wherein an overcoat layer c) is also simultaneously coated with layers a) and b).

9. The process of claim 8 wherein said overcoat layer comprises a cationically-modified cellulose ether.

10. The process of claim 9 wherein said cationically-modified cellulose ether is poly[β-D-1,4-anhydroglucose-g-oxyethylene-g-(2'-hydroxypropyl)-N,N-dimethyl-N-dodecylammonium chloride].

* * * * *